US010999001B2

(12) United States Patent
Chen et al.

(10) Patent No.: US 10,999,001 B2
(45) Date of Patent: May 4, 2021

(54) JAMMING DEVICE AND JAMMING METHOD

(71) Applicant: SZ DJI TECHNOLOGY CO., LTD., Shenzhen (CN)

(72) Inventors: Tao Chen, Shenzhen (CN); Renqin Deng, Shenzhen (CN); Yijun Tang, Shenzhen (CN); Mingguo Yi, Shenzhen (CN)

(73) Assignee: SZ DJI TECHNOLOGY CO., LTD., Shenzhen (CN)

( * ) Notice: Subject to any disclaimer, the term of this patent is extended or adjusted under 35 U.S.C. 154(b) by 27 days.

(21) Appl. No.: 16/591,066

(22) Filed: Oct. 2, 2019

(65) Prior Publication Data

US 2020/0136745 A1 Apr. 30, 2020

Related U.S. Application Data

(63) Continuation of application No. PCT/CN2017/079788, filed on Apr. 7, 2017.

(51) Int. Cl.
*H04K 3/00* (2006.01)

(52) U.S. Cl.
CPC ..... *H04K 3/42* (2013.01); *H04K 3/43* (2013.01); *H04K 2203/22* (2013.01); *H04K 2203/34* (2013.01)

(58) Field of Classification Search
CPC ..... H04K 3/42; H04K 3/43; H04K 2203/22; H04K 2203/34; H04K 3/00
See application file for complete search history.

(56) References Cited

U.S. PATENT DOCUMENTS 8,140,001 B2 * 3/2012 Haverty ..... H04K 3/45 455/1
8,175,512 B2 * 5/2012 Cornwell ..... H04K 3/42 455/1
8,903,304 B2 * 12/2014 Coleman ..... H04K 3/42 455/1
9,529,360 B1 * 12/2016 Melamed ..... G05D 1/0022
9,882,674 B1 * 1/2018 Defant ..... H04K 3/45
9,996,079 B2 * 6/2018 Magy ..... G08G 5/0043
(Continued)

FOREIGN PATENT DOCUMENTS

CN 101349740 A 1/2009
CN 101719296 A 6/2010
(Continued)

OTHER PUBLICATIONS

The World Intellectual Property Organization (WIPO) International Search Report and Written Opinion for PCT/CN2017/079788 dated Jan. 4, 2018 7 pages.
(Continued)

*Primary Examiner* — Ankur Jain
(74) *Attorney, Agent, or Firm* — Anova Law Group, PLLC

(57) ABSTRACT

A jamming device includes a periodic signal generating circuit configured to generate a periodic signal, a noise generating circuit configured to generate a noise signal, and a sweep-signal generating circuit coupled to the periodic signal generating circuit and the noise generating circuit. The sweep-signal generating circuit is configured to generate a frequency-sweep signal based on the periodic signal and the noise signal.

18 Claims, 5 Drawing Sheets

(56) References Cited

U.S. PATENT DOCUMENTS

| | | | | |
|---|---|---|---|---|
| 10,291,348 | B2 * | 5/2019 | Tran | B64C 39/024 |
| 10,545,245 | B2 * | 1/2020 | Ying | G01S 19/21 |
| 10,565,978 | B2 * | 2/2020 | Maziewski | G10K 11/1783 |
| 10,852,391 | B2 * | 12/2020 | Cornic | H04K 3/42 |
| 2010/0048154 | A1 * | 2/2010 | Rofougaran | H04B 1/109 455/233.1 |
| 2010/0176867 | A1 * | 7/2010 | Appel | H03B 29/00 327/361 |

FOREIGN PATENT DOCUMENTS

| | | | |
|---|---|---|---|
| CN | 102707266 | A | 10/2012 |
| CN | 102315895 | B | 5/2014 |
| CN | 203630356 | U | 6/2014 |
| CN | 105099585 | A | 11/2015 |
| CN | 204993363 | U | 1/2016 |
| CN | 105680981 | A | 6/2016 |
| CN | 205430267 | U | 8/2016 |
| CN | 106130686 | A | 11/2016 |
| CN | 106225583 | A | 12/2016 |
| EP | 0485552 | A1 | 5/1992 |
| JP | 2017028605 | A | 2/2017 |

OTHER PUBLICATIONS

The World Intellectual Property Organization (WIPO) International Search Report for PCT/CN2017/079662 dated Jan. 9, 2018 5 pages.

Yimin Zhang, Research on the Methods of Parameters Estimate and Jamming Technology for FHSS Communication Signal, Master's Thesis, Xidian University, Jan. 2006.

Mu Li, et al., Research on Methods of Sweeping Frequency Jamming for FH/SS Signals, Journal of UEST of China, vol. 25, No. 9, Dec. 1996.

Ying Zhou, et al., Design of a Simple GPS Jammer Using Gaussian White Noise, Aerospace Electronic Warfare, vol. 21, No. 6, 2005, pp. 15-18.

Yun Lu, et al., GPS Jamming Technology and Simulation Application, Electro-Optic Technology Application, vol. 19, No. 5, Oct. 2004.

* cited by examiner

JAMMING DEVICE AND JAMMING METHOD

CROSS-REFERENCE TO RELATED APPLICATION

This application is a continuation of International Application No. PCT/CN2017/079788, filed Apr. 7, 2017, the entire content of which is incorporated herein by reference.

TECHNICAL FIELD

The present disclosure relates to frequency jamming and, more particularly, to a jamming device and a jamming method using a narrow-bandwidth signal.

BACKGROUND

Mobile vehicles may use wireless signals of different frequencies for various purposes. For example, an unmanned aerial vehicle (UAV) may use a signal in one of the industrial, scientific and medical (ISM) radio frequency bands, such as the 2.4 GHz band or the 5.8 GHz band, for remote control or picture transmission. As another example, the UAV may use a radio frequency band for positioning and navigation, such as the 1575.42 MHz±1.023 MHz L1 band used in Global Positioning System (GPS), the 1602.5625 MHz±4 MHz L1 band used in Global Navigation Satellite System (GLONASS), or the 1561.098 MHz±2.046 MHz B1 band used in Beidou navigation system.

Sometimes, e.g., for monitoring or regulatory purposes, wireless communications with a mobile vehicle may need to be blocked. Blocking wireless communications using radio noise or signals is also referred to as radio jamming. Various techniques can be used for radio jamming, such as barrage jamming. Conventional jamming techniques usually includes either simultaneous transmission of jamming signals having frequencies over a wide range of frequency band or use of a jamming signal with a single frequency to scan through a wide range of frequency band.

However, a mobile vehicle usually does not use all available radio frequencies but may only use one or more narrower bands that may be separated from each other by certain gaps. For example, a UAV may be equipped multiple wireless communication modules for communicating with a remote controller using the 2.4 GHz band and the 5.8 GHz band, or navigation receivers for receiving signals from GPS, GLONASS, and Beidou navigation systems operating at different bands with different bandwidths. A conventional jamming that covers all these bands may also cover frequencies that are not used. As such, a lot of power may be wasted and the jamming efficiency may be low.

SUMMARY

In accordance with the present disclosure, there is provided a jamming device including a periodic signal generating circuit configured to generate a periodic signal, a noise generating circuit configured to generate a noise signal, and a sweep-signal generating circuit coupled to the periodic signal generating circuit and the noise generating circuit. The sweep-signal generating circuit is configured to generate a frequency-sweep signal based on the periodic signal and the noise signal.

Also in accordance with the present disclosure, there is provided a jamming method including generating a periodic signal, generating a noise signal, and generating a frequency-sweep signal based on the periodic signal and the noise signal.

Also in accordance with the present disclosure, there is provided a jamming apparatus including a first jamming device, a second jamming device, and a switch coupled to the first jamming device and the second jamming device, and configured to turn on or off at least one of the first jamming device or the second jamming device. The first jamming device includes a first periodic signal generating circuit configured to generate a first periodic signal, a first noise generating circuit configured to generate a first noise signal, and a first sweep-signal generating circuit coupled to the first periodic signal generating circuit and the first noise generating circuit. The first sweep-signal generating circuit is configured to generate a first frequency-sweep signal having a first sweep range based on the first periodic signal and the first noise signal. The second jamming device includes a second periodic signal generating circuit configured to generate a second periodic signal, a second noise generating circuit configured to generate a second noise signal, and a second sweep-signal generating circuit coupled to the second periodic signal generating circuit and the second noise generating circuit. The second sweep-signal generating circuit is configured to generate a second frequency-sweep signal having a second sweep range based on the second periodic signal and the second noise signal.

Also in accordance with the present disclosure, there is provided a jamming device including a jamming-signal generating circuit configured to generate a frequency-jamming signal having a center frequency and a bandwidth, a noise generating circuit coupled to the jamming-signal generating circuit and configured to modulate the bandwidth of the frequency jamming signal, and a controller coupled to the jamming-signal generating circuit and configured to generate a reference signal to control the center frequency of the frequency-jamming signal to switch among a plurality of predetermined frequencies.

Also in accordance with the present disclosure, there is provided a jamming method including generating a noise signal and generating a frequency jamming signal having a center frequency and a bandwidth. The bandwidth is modulated by the noise signal. The jamming method further includes controlling the center frequency to switch among a plurality of predetermined frequencies.

DESCRIPTION OF THE EMBODIMENTS

Hereinafter, embodiments consistent with the disclosure will be described with reference to the drawings, which are merely examples for illustrative purposes and are not intended to limit the scope of the disclosure. Wherever possible, the same reference numbers will be used throughout the drawings to refer to the same or like parts.

Figure 1:
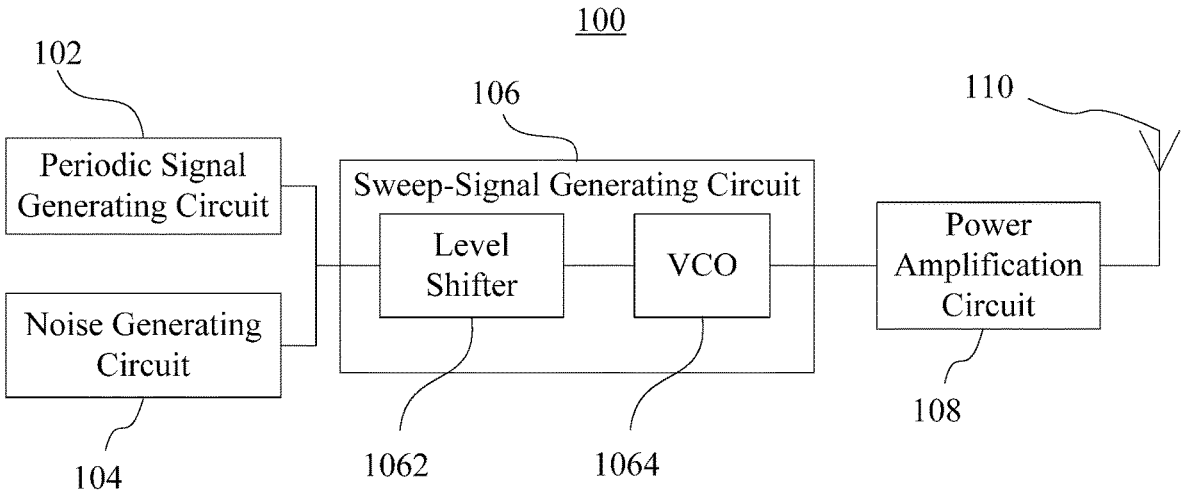
FIG. 1 is a schematic block diagram showing a jamming device according to an exemplary embodiment.

FIG. 1 is a schematic block diagram showing an exemplary jamming device 100 consistent with the disclosure. The jamming device 100 can be used to interfere with a wireless receiver such that the wireless receiver cannot effectively receive and analyze wireless signals of certain frequencies or frequency ranges, such as remote control signals or navigation signals. As shown in FIG. 1, the jamming device 100 includes a periodic signal generating circuit 102 configured to generate a periodic signal, a noise generating circuit 104 configured to generate a noise signal, and a sweep-signal generating circuit 106 that is coupled to both the periodic signal generating circuit 102 and the noise generating circuit 104. The sweep-signal generating circuit 106 is configured to generate a frequency-sweep signal based on the periodic signal and the noise signal.

Figure 2A:
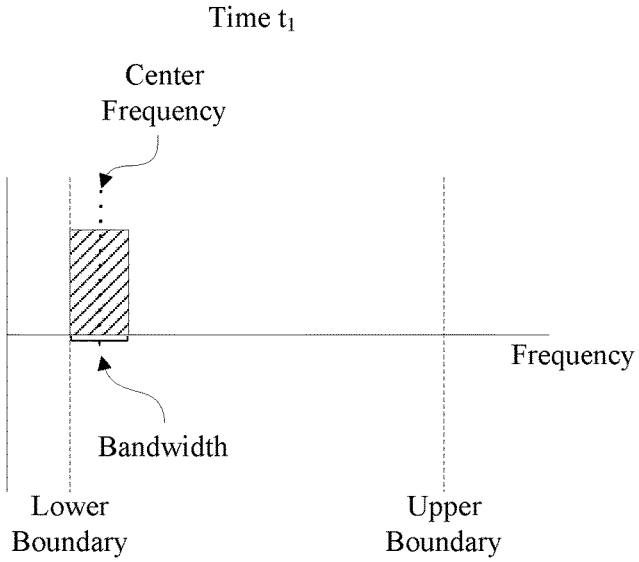
FIGS. 2A-2C schematically show a frequency-sweep signal at different time points during one sweep period according to an exemplary embodiment.
Figure 2B:
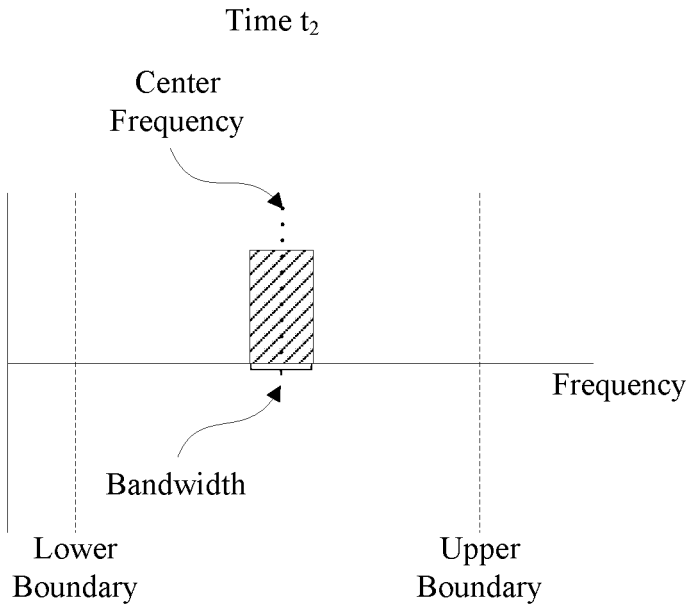
Figure 2C:
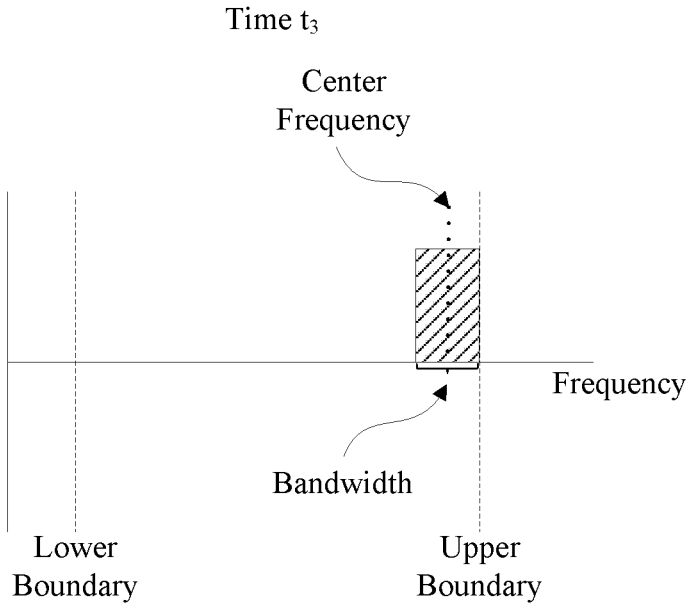

Consistent with embodiments of the disclosure, the frequency-sweep signal can include a narrow-band noise that has a bandwidth and a periodically changing center frequency. That is, the frequency-sweep signal can include a noise band that "sweeps" through a certain frequency range during each time period. Such a noise band is also referred to as a "sweeping noise." The frequency range that the sweeping noise sweeps through is also referred to as a "sweep range" and the time period that the sweeping noise sweeps through the sweep range is also referred to as a "sweep period." FIGS. 2A-2C schematically show the frequency-sweep signal at different time points $t_1$, $t_2$, and $t_3$ during one sweep period. In FIGS. 2A-2C, the shaded region represents the sweeping noise that contains noises of a plurality of frequencies. The two vertical dashed lines represent a lower and an upper boundaries of the sweep range, respectively. At time $t_1$ (FIG. 2A), the sweeping noise of the frequency-sweep signal is at the lower boundary of the sweep range. At time $t_2$ (FIG. 2B), the sweeping noise of the frequency-sweep signal is at a position between the lower boundary and the upper boundary of the sweep range. At time $t_3$ (FIG. 2C), the sweeping noise of the frequency-sweep signal is at the upper boundary of the sweep range. In the examples shown in FIGS. 2A-2C, $t_1$, $t_2$, and $t_3$ are merely exemplary time points for illustrative purposes. They are not necessarily in a particular order. Further, $t_1$ and $t_3$ may not necessarily be the beginning and the ending points of the sweep period.

In some embodiments, the sweep range can be chosen to encompass the range of frequencies of the wireless signal to be jammed. That is, the sweep range may be equal to or larger than the range of frequencies of the wireless signal to be jammed. For example, to jam a wireless signal that is transmitted in the 2.4 GHz band, the sweep range of the frequency-sweep signal can be from about 2.4 GHz to about 2.485 GHz, i.e., the frequency range of the 2.4 GHz band. As another example, to jam a wireless signal that is transmitted in the 5.8 GHz band, the sweep range of the frequency-sweep signal can be from about 5.7 GHz to about 5.85 GHz, i.e., the frequency range of the 5.8 GHz band.

The sweep period of the frequency-sweep signal can be chosen based on various factors, such as the wireless signal to be jammed. For example, a remote controller may use the frequency-hopping technology to transmit a wireless control signal by hopping among a plurality of frequency channels within a frequency band, such as the 2.4 GHz band or the 5.8 GHz band, during a certain period of time. A receiver that receives the control signal can correspondingly change its receiving channel to match the frequency of the control signal. The control signal may be controlled to remain at a certain frequency channel for a certain time length, also referred to as a "stay time." The stay time of the control signal can be, for example, about several hundreds of microseconds. If the sweep period is longer than the stay time of the control signal, it may be possible that the frequency-sweep signal misses a frequency channel when the control signal remains at that frequency channel. Thus, if the sweep period is longer than the stay time of the control signal, the jamming effect may be degraded. Therefore, in some embodiments, the sweep period can be chosen such that the frequency-sweep signal can sweep through the entire sweep range within the stay time, i.e., the sweep period can be equal to or shorter than the stay time. In some embodiments, the sweep period can be chosen to be shorter than one half of the stay time or even shorter, such that the frequency-sweep signal can interfere with the control signal two or more times within one sweep period.

The control signal transmitted by the remote controller may include a plurality of bytes of data, each being transmitted during a byte transmission time. In some embodiments, the sweep period of the frequency-sweep signal can be chosen to be equal to or shorter than the byte transmission time such that the frequency-sweep signal can interfere with each byte of data in the control signal, resulting in a better jamming effect. In some embodiments, the byte transmission time can be, for example, about 10 us or longer, and the sweep period can be chosen to be, for example, about 5 μs to about 10 μs. In some embodiments, the sweep period can be chosen to be, for example, about 5 μs.

The sweep range and the sweep period of the frequency-sweep signal can be controlled by the periodic signal generated by the periodic signal generating circuit 102, which has a periodically changing intensity. The intensity of the periodic signal can be represented by, for example, a voltage of the periodic signal. Thus, the periodic signal can have a varying voltage.

The center frequency of the sweeping noise of the frequency-sweep signal may depend on various factors, such as the voltage of the periodic signal. Therefore, the varying range of the voltage of the periodic signal can be controlled to control the varying range of the center frequency of the sweeping noise. In some embodiments, the center frequency of the sweeping noise may be proportional to the voltage of the periodic signal. Thus, a lower voltage of the periodic signal may correspond to a lower center frequency of the sweeping noise, while a higher voltage of the periodic signal may correspond to a higher center frequency of the sweeping noise.

As described above, the sweep range includes the frequency range that the sweeping noise sweeps through during the sweep period. As described below, the sweeping noise has a bandwidth larger than zero. Thus, the sweep range can be the sum of the bandwidth of the sweeping noise and the varying range of the center frequency of the sweeping noise, i.e., the sweep range can be wider than the varying range of the center frequency of the sweeping noise. However, the bandwidth of the sweeping noise is usually much narrower as compared to the frequency range to be jammed. For example, the bandwidth of the sweeping noise can be about 2 MHz, much narrower than the frequency range of the 2.4 GHz band, which can be about 85 MHz (about 2.4 GHz to about 2.485 GHz), and also much narrower than the frequency range of the 5.8 GHz band, which can be about 150 MHz (about 5.7 GHz to about 5.85 GHz). Therefore, the contribution of the bandwidth of the sweeping noise to the sweep range can be relatively small and sometimes negligible. Thus, the varying range of the voltage of the periodic signal can approximately determine the sweep range.

In some embodiments, the period of the periodic signal can determine the sweep period of the frequency-sweep signal. In some embodiments, the sweep period of the frequency-sweep signal is approximately equal to the period of the periodic signal. Thus, the periodic signal generating circuit 102 can be configured to generate the periodic signal having a period corresponding to the needed sweep period. For example, the periodic signal generating circuit 102 can be configured to generate a periodic signal having a period of about 5 μs to about 10 μs. As another example, the periodic signal generating circuit 102 can be configured to generate a periodic signal having a period of about 5 μs.

The periodic signal generating circuit 102 can be any circuit or device that can generate a periodic signal that has a continuously varying voltage within at least a portion of the period. The continuously varying voltage of the periodic signal can cause the sweeping noise generated by the sweep-signal generating circuit 106 to continuously sweep through the sweep range. In some embodiments, the periodic signal generating circuit 102 includes a linear periodic signal generating circuit that can generate a periodic signal having a voltage that changes linearly during the period or a portion of the period of the periodic signal. The linearly changing voltage of the periodic signal can cause the sweeping noise to sweep through the sweep range at an approximately constant speed, such that the sweeping noise can interfere with each of the frequency channels of the wireless signal to be jammed for approximately the same amount of time. This ensures that each frequency channel of the wireless signal be effectively jammed.

In some embodiments, the periodic signal generating circuit 102 can include a sawtooth wave generating circuit configured to generate a sawtooth wave as the periodic signal. During one period of the sawtooth wave, the voltage of the signal can increase linearly to a highest level and then quickly drop to a lowest level. The sawtooth wave generating circuit can include, for example, a generating circuit based on an RC circuit or a generating circuit based on an operational amplifier. A particular example of the sawtooth wave generating circuit can include a generating circuit based on a 555 timer, which can be configured to operate in an a stable mode, i.e., a free-running mode.

In some other embodiments, the periodic signal generating circuit 102 can include a triangle wave generating circuit configured to generate a triangle wave as the periodic signal. During one period of the triangle wave, the voltage of the signal can increase linearly to a highest level and decrease linearly to a lowest level. The triangle wave generating circuit can include, for example, a generating circuit based on an RC circuit or a generating circuit based on an operational amplifier.

In some embodiments, the periodic signal generating circuit 102 can include a non-linear periodic signal generating circuit configured to generate a non-linear periodic signal, such as a sinusoidal wave, as the periodic signal.

As described above, the frequency-sweep signal can include a sweeping noise that sweeps through the sweep range during the sweep period. In some embodiments, the sweeping noise can include a narrow-band noise having a narrow bandwidth, e.g., a bandwidth much smaller than the center frequency of the sweeping noise. In some embodiments, the bandwidth of the sweeping noise can be smaller than, e.g., about 1% of the center frequency of the sweeping noise. In some embodiments, the bandwidth of the sweeping noise can be approximately equal to or slightly wider than the width of the frequency channel for transmitting the wireless signal to be jammed, such that the sweeping noise can cover an entire frequency channel at certain time points. Therefore, the jamming efficiency can be increased as compared to a jamming device using a single-frequency sweeping signal. In other words, with a same jamming power, the jamming distance of the jamming device consistent with embodiments of the disclosure can be longer than the jamming distance of a jamming device using a single-frequency sweeping signal. In some embodiments, the bandwidth of the sweeping noise can be chosen to be about 2 MHz.

The bandwidth of the sweeping noise of the frequency-sweep signal generated by the sweep-signal generating circuit 106 can be controlled by an amplitude of the noise signal generated by the noise generating circuit 104. In some embodiments, the bandwidth of the sweeping noise can be proportional to the amplitude of the noise signal.

Figure 3:
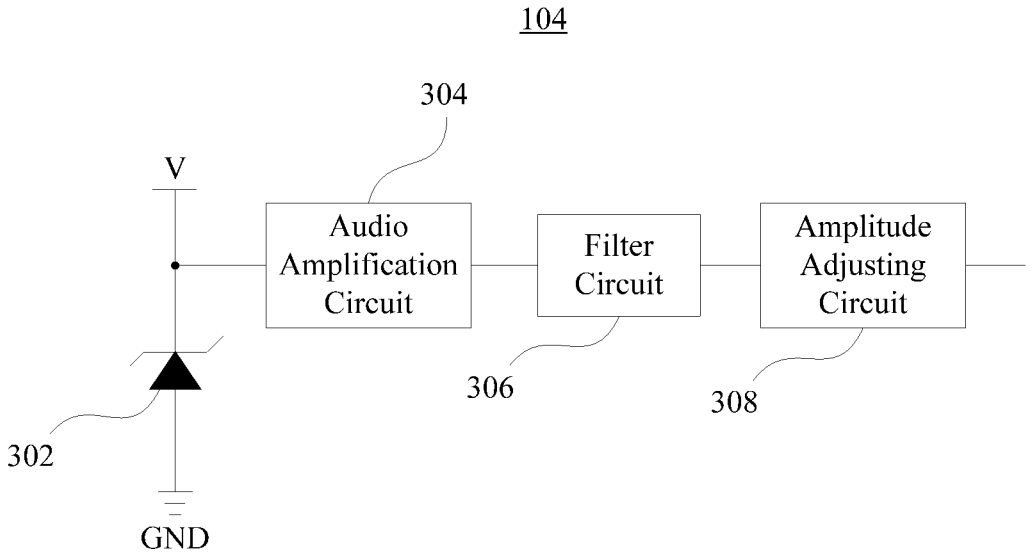
FIG. 3 schematically shows a circuit diagram of a noise generating circuit according to an exemplary embodiment.

The noise generating circuit 104 can include any circuit that is capable of generating a suitable noise signal. In some embodiments, the noise generating circuit 104 can be configured to generate a narrow-band noise as the noise signal. In some embodiments, the noise generating circuit 104 can be configured to generate a narrow-band white Gaussian noise as the noise signal. FIG. 3 shows a circuit diagram of an example of the noise generating circuit 104 consistent with embodiments of the disclosure. As shown in FIG. 3, the noise generating circuit 104 includes a reverse-biased Zener diode 302 coupled between a voltage source V and a ground GND. The Zener diode 302 can be used to generate a white noise that can be used for controlling the bandwidth of the sweeping noise of the frequency-sweep signal.

Sometimes, the amplitude of the white noise generated by the Zener diode 302 may not be large enough to meet the bandwidth requirement of the sweeping noise. Therefore, in some embodiments, as shown in FIG. 3, the noise generating circuit 104 further includes an audio amplification circuit 304 coupled to the Zener diode 302 and configured to amplify the white noise generated by the Zener diode 302. Further, in some embodiments, the noise generating circuit 104 also includes a filter circuit 306 coupled to the audio amplification circuit 304 and configured to filter an output of the audio amplification circuit 304. For example, the filter circuit 306 may filter and thus limit the frequency range of the amplified white noise.

In some embodiments, as shown in FIG. 3, the noise generating circuit 104 further includes an amplitude adjusting circuit 308 coupled to the filter circuit 306 and configured to adjust the amplitude of the output of the filter circuit 306. By using the amplitude adjusting circuit 308, the amplitude of the noise signal generated by the noise generating circuit 104 can be further adjusted. In some embodiments, the amplitude adjusting circuit 308 can include, for example, a resistor or a signal amplifier. The resistor can include, for example, an adjustable resistor. The signal amplifier can include, for example, a variable-gain amplifier. By adjusting the resistance of the adjustable resistor or the gain of the variable-gain amplifier, the amplitude of the noise signal output by the noise generating circuit 104 can be further adjusted to accommodate the need of sweeping noises having different bandwidths.

Referring again to FIG. 1, the sweep-signal generating circuit 106 includes a level shifter (level shifting circuit) 1062 and a voltage-controlled oscillator (VCO) 1064 coupled to the output terminal of the level shifter 1062. As shown in FIG. 1, the level shifter 1062 is coupled to the periodic signal generating circuit 102 and the noise generating circuit 104, and receives the periodic signal output by the periodic signal generating circuit 102 and the noise signal output by the noise generating circuit 104. In some embodiments, the level shifter 1062 is configured to combine the periodic signal and the noise signal. That is, the level shifter 1062 can superimpose the noise signal on the periodic signal to generate a combined signal, also referred to as a superimposed periodic signal. The superimposed periodic signal can have an approximately same period as the periodic signal generated by the periodic signal generating circuit 102, with a voltage "modified" by the noise signal.

In some embodiments, the level shifter 1062 can include an operational amplifier. In some embodiments, the operational amplifier can be configured as an adder or a subtractor. In some embodiments, the operational amplifier can be configured to shift the voltage level of the superimposed periodic signal positively or negatively, i.e., to increase or to decrease the voltage level of the superimposed periodic signal. As such, the superimposed periodic signal can have a voltage level needed by the VCO 1064 to generate the frequency-sweep signal in the appropriate frequency range.

The level shifter 1062 can output the superimposed periodic signal to the VCO 1064, which can generate the frequency-sweep signal according to the superimposed periodic signal. VCO is a device that can generate an output signal having a frequency depending on the voltage of an input signal. Thus, a periodic input signal to the VCO can cause the VCO to generate an output signal having a periodically changing frequency. Further, a periodic input signal superimposed with a noise signal can cause the VCO to generate an output signal having a bandwidth and a periodically changing frequency. In some embodiments, the VCO 1064 is configured to convert the superimposed periodic signal to the frequency-sweep signal that covers the frequency band of the wireless signal to be jammed.

In some embodiments, as shown in FIG. 1, the jamming device 100 further includes a power amplification circuit 108 coupled to the sweep-signal generating circuit 106 and configured to amplify the power of the frequency-sweep signal to generate an amplified frequency-sweep signal. The power amplification circuit 108 can include, for example, one or more of a driver amplifier or a power amplifier. In some embodiments, the jamming device 100 also includes an antenna or antenna set 110 coupled to the power amplification circuit 108 and configured to transmit the amplified frequency-sweep signal to the outside environment.

As described above, the jamming device 100 can be configured to jam wireless signals in different radio frequency bands by configuring the periodic signal generating circuit 102 and/or the sweep-signal generating circuit 106 (e.g., the VCO 1064). For example, by using different combinations of the periodic signal generating circuit 102 and the VCO 1064, the sweep range of the frequency-sweep signal can be configured to jam wireless signals in different radio frequency bands.

In some embodiments, multiple jamming devices 100 can be combined together to realize the jamming of multiple radio frequency bands.

Figure 4:
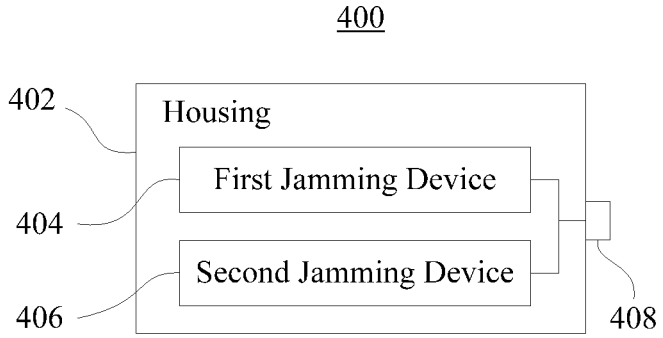
FIG. 4 is a schematic block diagram showing a jamming apparatus according to an exemplary embodiment.

FIG. 4 is a block diagram of an exemplary jamming apparatus 400 consistent with embodiments of the disclosure. As shown in FIG. 4, the jamming apparatus 400 includes a housing 402, a first jamming device 404, and a second jamming device 406. Each of the first jamming device 404 and the second jamming device 406 can be partially or completely mounted in or on the housing 402.

Further, each of the first jamming device 404 and the second jamming device 406 can include a jamming device consistent with embodiments of the disclosure, such as the jamming device 100. In some embodiments, the first jamming device 404 can be configured to generate a first frequency-sweep signal having a first sweep range and a first sweep period, and the second jamming device 406 can be configured to generate a second frequency-sweep signal having a second sweep range and a second sweep period. In some embodiments, the first sweep range can be different from the second sweep range. For example, the first sweep range can include a frequency range from about 2.4 GHz to about 2.485 GHz while the second sweep range can include a frequency range from about 5.7 GHz to about 5.85 GHz. The first sweep period and the second sweep period can be the same as or different from each other.

More specifically, the first jamming device 404 may include a first periodic signal generating circuit configured to generate a first periodic signal, a first noise generating circuit configured to generate a first noise signal, and a first sweep-signal generating circuit coupled to the first periodic signal generating circuit and the first noise generating circuit and configured to generate the first frequency-sweep signal based on the first periodic signal and the first noise signal. Similarly, the second jamming device 406 may include a second periodic signal generating circuit configured to generate a second periodic signal, a second noise generating circuit configured to generate a second noise signal, and a second sweep-signal generating circuit coupled to the second periodic signal generating circuit and the second noise generating circuit and configured to generate the second frequency-sweep signal based on the second periodic signal and the second noise signal. The structure of each of the first jamming device 404 and the second jamming device 406 can be similar to the structure of the jamming device 100 described above, and thus detailed description thereof is omitted.

In some embodiments, as shown in FIG. 4, the jamming apparatus 400 further includes a switch 408 coupled to the first jamming device 404 and the second jamming device 406. The switch 408 can be configured to turn on or off one or both of the first jamming device 404 and the second jamming device 406. Thus, the jamming apparatus 400 can be used to jam one of the two radio frequency bands as needed or to jam both radio frequency bands at the same time.

In some embodiments, the jamming apparatus 400 can include three or more jamming devices, each of which can be the same as or similar to the jamming device 100 and be configured to jam one of several radio frequency bands. In some embodiments, the jamming apparatus 400 can include only one jamming device consistent with embodiments of the disclosure, such as one of the jamming devices 100, 404, and 406 described above. In these embodiments, the switch 408 can be configured to, e.g., turn on or off the jamming device.

Figure 5:
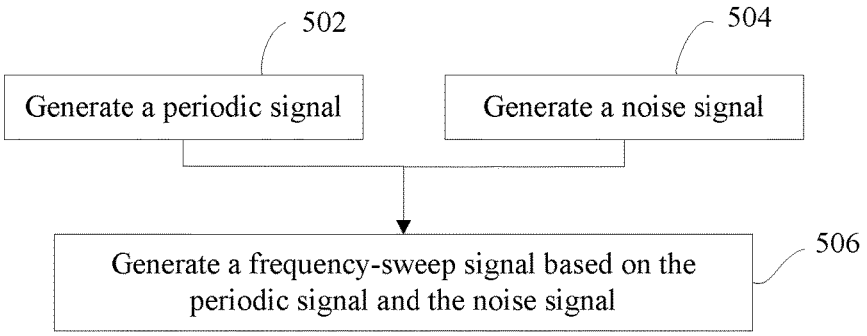
FIG. 5 is a flow chart showing a jamming method according to an exemplary embodiment.

FIG. 5 is a flow chart of an exemplary jamming method consistent with embodiments of the disclosure. The method can be implemented in a jamming device consistent with embodiments of the disclosure, such as one of the exemplary jamming devices described above. As shown in FIG. 5, at 502, a periodic signal is generated. At 504, a noise signal is generated. At 506, a frequency-sweep signal is generated based on the periodic signal and the noise signal. The jamming method may further includes operations performed by various components of the jamming device 100 as described above. Therefore, detailed description of the jamming method is omitted here.

In the above embodiments, exemplary jamming devices and jamming methods using a frequency-sweep signal having a narrow-band sweeping noise are described. The jamming devices and jamming methods described above can be used to jam one frequency band or a plurality of frequency bands. In some other embodiments, instead of sweeping through a frequency range encompassing a plurality of frequency bands used for wireless transmission, a jamming signal can "hop" among such frequency bands, as described below. This hopping method can be used to, for example, jam multiple frequency bands having relatively small bandwidths, such as navigations signals from the Global Positioning System (GPS) (having a bandwidth of about 2.046 MHz), the Global Navigation Satellite System (GLONASS) (having a bandwidth of about 8 MHz), or the Beidou navigation system (having a bandwidth of about 4.092 MHz).

Figure 6:
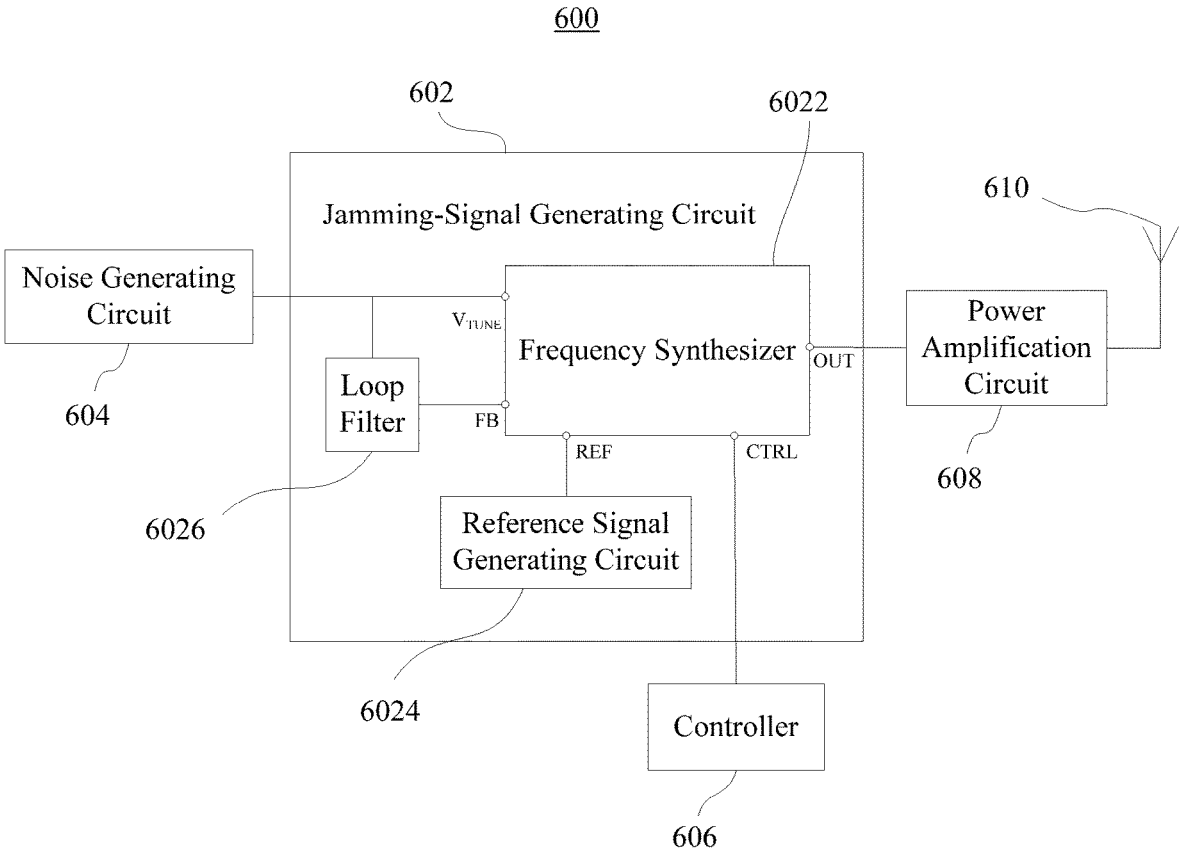
FIG. 6 is a schematic block diagram showing a jamming device according to another exemplary embodiment.

FIG. 6 is a schematic block diagram showing another exemplary jamming device 600 consistent with the disclosure. As shown in FIG. 6, the jamming device 600 includes a jamming-signal generating circuit 602 configured to generate a frequency-jamming signal having a center frequency and a bandwidth, a noise generating circuit 604 coupled to the jamming-signal generating circuit 602 and configured to control (modulate) the bandwidth of the frequency-jamming signal, and a controller 606 coupled to the jamming-signal generating circuit 602 and configured to control the center frequency of the frequency jamming signal to switch, i.e., hop, among a plurality of predetermined frequencies.

As shown in FIG. 6, the jamming-signal generating circuit 602 includes a frequency synthesizer 6022 and a reference signal generating circuit 6024 coupled to each other. The reference signal generating circuit 6024 is configured to generate a reference signal having a reference frequency $f_{ref}$ and provide the reference signal to the frequency synthesizer 6022 through a reference port, REF, of the frequency synthesizer 6022 for further processing. In some embodiments, the reference signal generating circuit 6024 can include, for example, a crystal oscillator.

The noise generating circuit 604 is configured to generate a noise signal and provide the noise signal to the frequency synthesizer 6022 through a tuning port, $V_{TUNE}$, of the frequency synthesizer 6022 to tune (modulate) the bandwidth of the frequency jamming signal. In some embodiments, the noise signal can include a narrow-band noise, such as a narrow-band white Gaussian noise.

The noise signal can expand the bandwidth of the frequency jamming signal from zero (or approximately zero) to a small but non-zero value. The bandwidth of the frequency jamming signal can depend on the amplitude of the noise signal. For example, the bandwidth of the frequency jamming signal can be proportional to the amplitude of the noise signal. Therefore, by changing the amplitude of the noise signal, the bandwidth of the frequency jamming signal can be changed.

In some embodiments, the noise generating circuit can be configured to provide different bandwidths of the frequency jamming signal for different frequency bands to be jammed as needed. For example, for a frequency band to be jammed with a wider bandwidth, the noise generating circuit can modulate the frequency jamming signal to have a wider bandwidth. In some embodiments, the noise generating circuit can be configured to provide a same bandwidth of the frequency jamming signal for some or all of the frequency bands to be jammed.

In some embodiments, the bandwidth of the frequency jamming signal can be a narrow bandwidth, e.g., a bandwidth much smaller than the center frequency of the frequency jamming signal. In some embodiments, the bandwidth of the frequency jamming signal can be smaller than, e.g., about 1% of the center frequency of the frequency jamming signal. For example, the noise generating circuit 604 can be configured to control the amplitude of the noise signal to modulate the bandwidth of the frequency jamming signal to be about 2 MHz.

The noise generating circuit 604 can be similar to the noise generating circuit 104 described above and, in some embodiments, can have a structure similar to that shown in FIG. 3. Therefore, detailed description of the noise generating circuit 604 is omitted.

In some embodiments, the frequency synthesizer 6022 can output a feedback signal through a feedback port, FB, of the frequency synthesizer 6022. As described in more detail below, the feedback signal can be generated based on a frequency related to a center frequency of the generated frequency-jamming signal, a frequency of the reference signal, and certain stored data (e.g., frequency division ratios as described below) that can be configured by a control signal output by the controller 606, and thus can carry information for controlling the center frequency of the frequency jamming signal. In some embodiments, the feedback signal can include a voltage signal. A voltage value of the voltage signal can be used to indicate and control the center frequency of the frequency-jamming signal.

In some embodiments, the feedback signal and the noise signal are combined and provided to the frequency synthesizer 6022 through the tuning port. As described above, the feedback signal can tune the center frequency of the frequency jamming signal and the noise signal can control the bandwidth of the frequency jamming signal.

In some embodiments, as shown in FIG. 6, the jamming-signal generating circuit 602 further includes a loop filter 6026 coupled between the feedback port and the tuning port of the frequency synthesizer 6022. The loop filter 6026 can be configured to, for example, reduce a frequency fluctuation of the output frequency-jamming signal, reduce a time needed to switch from one center frequency to another center frequency, and/or reduce a time needed to lock the center frequency when the jamming device 600 is first turned on. In some embodiments, the loop filter 6026 can include, for example, a low-pass filter.

The controller 606 is configured to generate the control signal and provide the control signal to the frequency synthesizer 6022 through a control port, CTRL, of the frequency synthesizer 6022. The control signal can work together with the reference signal to control the center frequency of the frequency jamming signal, as will be described in more detail below. By changing the control signal, the center frequency of the frequency-jamming signal can hop among the plurality of predetermined frequencies. In some embodiments, the plurality of predetermined frequencies can include, for example, at least two of a first frequency in the range from about 1574.397 MHz to about 1576.443 MHz, a second frequency in the range from about 1598.5625 MHz to about 1606.5625 MHz, and a third frequency in the range from about 1559.052 MHz to about 1563.144 MHz. In some embodiments, the first frequency can be about 1575.42 MHz. In some embodiments, the second frequency can be about 1602.5635 MHz. In some embodiments, the third frequency can be about 1561.098 MHz.

In some embodiments, the controller 606 can be configured to control the center frequency of the frequency jamming signal to switch among the predetermined frequencies at a predetermined period. The predetermined period may refer to the period of time during which the center frequency of the frequency jamming signal hops from one of the predetermined frequencies through all of the predetermined frequencies and back to the one of the predetermined frequencies. In some embodiments, the predetermined period can be determined according to the frequency bands to be jammed. In some embodiments, the predetermined period can be set to be shorter than a transmission cycle of the wireless signals to be jammed. That is, the controller 606 can control the center frequency of the frequency-jamming signal to hop through all of the predetermined frequencies within a period shorter than the transmission cycle of the wireless signals. Depending on the number of frequency bands to be jammed, the center frequency of the frequency jamming signal can be controlled to remain at a predetermined frequency for different time lengths. That is, given a certain predetermined period, the more frequency bands to be jammed, the shorter time length the center frequency of the frequency-jamming signal may be controlled to remain at a predetermined frequency. In some embodiments, the predetermined period can be set to be two or more times shorter than the transmission cycle of the wireless signals to be jammed. As such, during one transmission cycle of the wireless signals to be jammed, the frequency jamming signal can interfere with the wireless signals more than once. Therefore, the jamming effect can be improved.

For example, navigation systems usually transmit navigation signals at a transmission cycle of about one or several seconds, and thus the predetermined period can be set to be shorter than one second. In some embodiments, the controller 606 can be configured to change the center frequency of the frequency jamming signal about every 10 ms to 20 ms, i.e., the center frequency of the frequency jamming signal may be controlled to remain at one predetermined frequency for about 10 ms to about 20 ms.

In some embodiments, the controller 606 can include a micro-controller unit that can output different control signals at the predetermined period. In some embodiments, the controller 606 can include a timer or a time delay circuit for controlling the timing of outputting the control signals.

In some embodiments, as shown in FIG. 6, the jamming device 600 further includes a power amplification circuit 608 coupled to the jamming-signal generating circuit 602 and configured to amplify the power of the frequency-jamming signal to generate an amplified frequency jamming signal. In some embodiments, the power amplification circuit 608 can be coupled to an output port, OUT, of the frequency synthesizer 6022. The power amplification circuit 608 can include, for example, one or more of a driver amplifier or a power amplifier. In some embodiments, the jamming device 600 also includes an antenna or antenna set 610 coupled to the power amplification circuit 608 and configured to transmit the amplified frequency-jamming signal to the outside environment.

Figure 7:
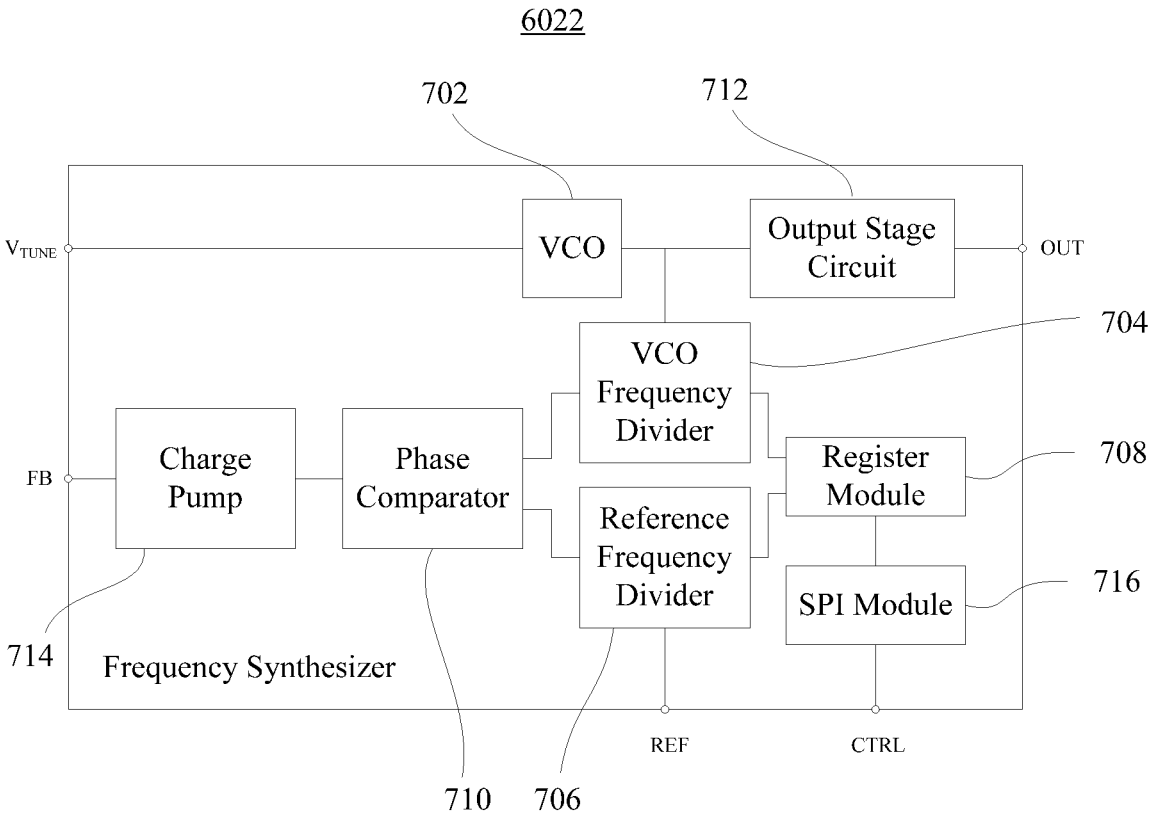
FIG. 7 is a schematic block diagram showing a frequency synthesizer according to an exemplary embodiment.

FIG. 7 is a schematic block diagram showing an example of the frequency synthesizer 6022 consistent with embodiments of the disclosure. As shown in FIG. 7, the frequency synthesizer 6022 includes a VCO 702, a first frequency divider (VCO frequency divider) 704, a second frequency divider (reference frequency divider) 706, a register module 708, and a phase comparator 710.

The VCO 702 can be similar to the VCO 1064, and thus detailed description thereof is omitted. As shown in FIG. 7, an input terminal of the VCO 702 is coupled to the tuning port of the frequency synthesizer 6022. The VCO 702 is configured to receive the noise signal and the feedback signal, and generate a VCO output signal based on the noise signal and the feedback signal. In some embodiments, the VCO output signal can be directly output through the output port of the frequency synthesizer 6022 as the frequency jamming signal. In some embodiments, as shown in FIG. 7, the frequency synthesizer 6022 further includes an output stage circuit 712 coupled between an output terminal of the VCO 702 and the output port of the frequency synthesizer 6022. The output stage circuit 712 can output a signal as the frequency-jamming signal based on the VCO output signal.

As shown in FIG. 7, the output terminal of the VCO 702 is coupled to an input terminal of the VCO frequency divider 704. The VCO frequency divider 704 can be configured to receive the VCO output signal and divide frequencies of the VCO output signal by a first frequency division ratio (VCO frequency division ratio) N, so as to reduce the frequency of the VCO output signal. For example, assume the center frequency of the VCO output signal is $f_{VCO}$. The VCO frequency divider 704 can divide the center frequency $f_{VCO}$ by the VCO frequency division ratio N to generate a first frequency-reduced signal (frequency-reduced VCO signal) having a center frequency of $f_{VCO}/N$. An output terminal of the VCO frequency divider 704 can be coupled to a first input terminal (VCO signal input terminal) of the phase comparator 710. The VCO frequency divider 704 can send the frequency-reduced VCO signal to the phase comparator 710 through the VCO signal input terminal.

Similarly, as shown in FIG. 7, an input terminal of the reference frequency divider 706 is coupled to the reference port of the frequency synthesizer 6022 to receive the reference signal generated by the reference signal generating circuit 6024. The reference frequency divider 706 can be configured to divide the reference frequency $f_{ref}$ by a second frequency division ratio (reference frequency division ratio) R, so as to reduce the frequency of the reference signal. That is, the reference frequency divider 706 can divide the reference frequency $f_{ref}$ by the reference frequency division ratio R to generate a second frequency-reduced signal (frequency-reduced reference signal) having a frequency of $f_{ref}/R$. An output terminal of the reference frequency divider 706 can be coupled to a second input terminal (reference signal input terminal) of the phase comparator 710. The reference frequency divider 706 can send the frequency-reduced reference signal to the phase comparator 710 through the reference signal input terminal.

The phase comparator 710 is configured to compare the frequency-reduced VCO signal and the frequency-reduced reference signal to generate a difference signal indicating the difference between the frequency-reduced VCO signal and the frequency-reduced reference signal, and thus indirectly indicating the difference between the frequency jamming signal and the reference signal. The difference between the frequency-reduced VCO signal and the frequency-reduced reference signal can include, for example, at least a phase difference between a phase of the frequency-reduced VCO signal and a phase of the frequency-reduced reference signal. In some embodiments, the difference signal may have a voltage representing the difference, such as the phase difference. In some embodiments, the difference signal may include a phase-difference signal generated based on the phase of the frequency-reduced VCO signal and the phase of the frequency-reduced reference signal.

In some embodiments, the difference signal generated by the phase comparator 710 can be output directly through the feedback port of the frequency synthesizer 6022 as the feedback signal. In some embodiments, as shown in FIG. 7, the frequency synthesizer 6022 further includes a charge pump 714 coupled between an output terminal of the phase comparator 710 and the feedback port of the frequency synthesizer 6022. The charge pump 714 can be configured to change the voltage of the difference signal. That is, the voltage of the difference signal may be modified while passing through the charge pump 714. The difference signal after the voltage modification performed by the charge pump 714 is also referred to as a voltage-modified difference signal. The charge pump 714 can then output the voltage-modified difference signal as the feedback signal.

As can be seen from FIG. 7 and the description above, the VCO frequency divider 704, the reference frequency divider 706, and the phase comparator 710 (and, in some embodiments, the charge pump 714) form a negative feedback loop that allows the center frequency of the VCO output signal, and hence the center frequency of the frequency-jamming signal, to "trace" the frequency of the reference signal. On the one hand, this negative feedback can allow the frequency synthesizer 6022 to lock the center frequency of the frequency-jamming signal to avoid temperature drift of the center frequency. Further, as described below, this negative feedback can be used to switch the center frequency of the frequency synthesizer 6022.

In some embodiments, the difference signal generated by the phase comparator 710 (or the voltage-modified difference signal in the embodiments having the charge pump 714) can be used to adjust the center frequency of the VCO output signal such that the following relationship is satisfied:

$$\frac{f_{VCO}}{N} = \frac{f_{ref}}{R} \tag{1}$$

This equation can be rewritten as:

$$f_{VCO} = \frac{N}{R} f_{ref} \tag{2}$$

It is seen from Equation (2) that, when the reference frequency $f_{ref}$ is given, the center frequency of the VCO output signal, and hence the center frequency of the frequency-jamming signal, can be adjusted by adjusting the ratio N/R. Thus, by controlling the ratio N/R to switch among a plurality of values, the center frequency of the frequency jamming signal can be controlled to switch among the plurality of predetermined frequencies.

In some embodiments, the frequency division ratios N and R can be configured in the register module 708. In some embodiments, the register module 708 can be directly coupled to the control port of the frequency synthesizer 6022 to receive the control signal provided by the controller 606. In some embodiments, as shown in FIG. 7, the frequency synthesizer 6022 further includes a serial peripheral interface (SPI) module 716 coupled between the register module 708 and the control port. In these embodiments, the control signal can be transmitted to the register module 708 by the SPI module 716.

The register module 708 can include one or more registers configured to store the frequency division ratios N and R. The frequency division ratios N and R can be stored in a same register, separately stored in different registers, or collectively stored in multiple registers. The control signal can configure the frequency division ratios N and R stored in the one or more registers. Thus, by configuring the frequency division ratios N and R stored in the one or more registers using the control signal, the controller 606 can configure the center frequency of the VCO output signal, and hence the center frequency of the frequency-jamming signal. Therefore, the controller 606 can control the center frequency of the frequency-jamming signal to switch among the predetermined frequencies.

In some embodiments, one of the VCO frequency divider 704 or the reference frequency divider 706 can be omitted. That is, one of the VCO frequency division ratio N and the reference frequency division ratio R can be set to one. In these embodiments, the controller 606 can control the center frequency of the frequency-jamming signal by configuring the other one of the VCO frequency division ratio N and the reference frequency division ratio R.

In some embodiments, the various components of the frequency synthesizer 6022 shown in FIG. 7 can be separate, individual components or circuits coupled together via wirings. In some embodiments, the frequency synthesizer 6022 can include an integrated circuit (IC) chip with different portions of the IC chip being configured to function as the various components shown in FIG. 7.

Referring again to FIG. 4, in some embodiments, each of the first jamming device 404 and the second jamming device 406 can include a jamming device that is the same as or similar to the jamming device 600. In some embodiments, the first jamming device 404 can be configured to generate a frequency jamming signal that hops among a first group of predetermined frequencies and the second jamming device 406 can be configured to generate a frequency jamming signal that hops among a second group of predetermined frequencies. In some embodiments, the predetermined frequencies in the first group can be at least partially different from the predetermined frequencies in the second group.

In some embodiments, the jamming apparatus 400 can include three or more jamming devices, each of which can be the same as or similar to the jamming device 600, and be configured to jam one of several groups of radio frequency bands. In some embodiments, the jamming apparatus 400 can include only one jamming device consistent with embodiments of the disclosure, such as the jamming device 600 described above. In these embodiments, the switch 408 can be configured to, e.g., turn on or off the jamming device.

In some embodiments, the jamming apparatus 400 can include two or more jamming devices, each of which can be the same as or similar to the jamming device 100 or the jamming device 600.

Figure 8:
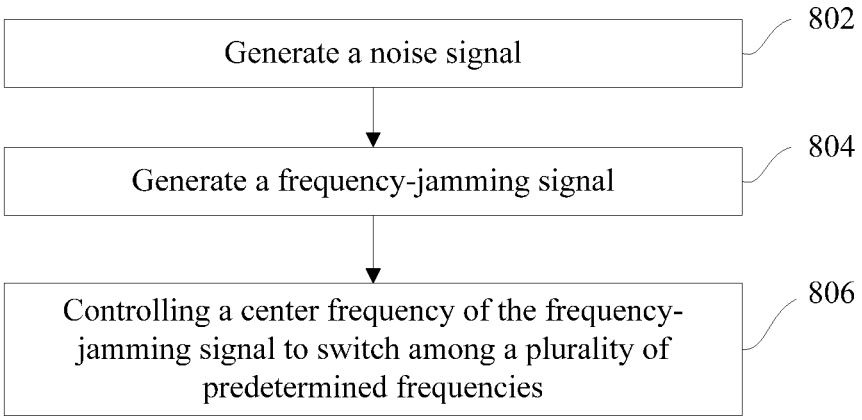
FIG. 8 is a flow chart showing a jamming method according to another exemplary embodiment.

FIG. 8 is a flow chart of another exemplary jamming method consistent with embodiments of the disclosure. The method can be implemented in a jamming device consistent with embodiments of the disclosure, such as one of the exemplary jamming devices described above. As shown in FIG. 8, at 802, a noise signal is generated. At 804, a frequency jamming signal is generated. The frequency jamming signal has a center frequency and a bandwidth. The bandwidth can be modulated by the noise signal. At 806, the center frequency is controlled to switch among a plurality of predetermined frequencies. The jamming method may further include operations performed by various components of the jamming device 600 as described above. Therefore, detailed description of the jamming method is omitted here.

The processes shown in the figures associated with the method embodiments can be executed or performed in any suitable order or sequence, which is not limited to the order and sequence shown in the figures and described above. For example, two consecutive processes may be executed substantially simultaneously where appropriate or in parallel to reduce latency and processing times, or be executed in an order reversed to that shown in the figures, depending on the functionality involved.

Further, the components in the figures associated with the device embodiments can be coupled in a manner different from that shown in the figures as needed. Some components may be omitted and additional components may be added.

Other embodiments of the disclosure will be apparent to those skilled in the art from consideration of the specification and practice of the embodiments disclosed herein. It is intended that the specification and examples be considered as exemplary only and not to limit the scope of the disclosure, with a true scope and spirit of the invention being indicated by the following claims.

What is claimed is:

1. A jamming device comprising:

a periodic signal generating circuit configured to generate a periodic signal;

a noise generating circuit configured to generate a noise signal; and a sweep-signal generating circuit coupled to the periodic signal generating circuit and the noise generating circuit, the sweep-signal generating circuit being configured to generate a frequency-sweep signal based on the periodic signal and the noise signal, and the sweep-signal generating circuit comprising:

a level shifter coupled to the periodic signal generating circuit and the noise generating circuit, the level shifter being configured to superimpose the noise signal on the periodic signal to generate a superimposed periodic signal; and a voltage-controlled oscillator (VCO) coupled to the level shifter and configured to generate the frequency-sweep signal according to the superimposed periodic signal.

2. The jamming device of claim 1, wherein the level shifter comprises an operational amplifier.

3. The jamming device of claim 2, wherein the operational amplifier is configured as an adder or a subtractor.

4. The jamming device of claim 2, wherein the operational amplifier is further configured to increase or decrease a voltage level of the superimposed periodic signal.

5. The jamming device of claim 1, wherein the VCO is configured to generate the frequency-sweep signal having a sweep range from about 2.4 GHz to about 2.485 GHz or a sweep range from about 5.7 GHz to about 5.85 GHz.

6. The jamming device of claim 1, wherein the VCO is configured to generate the frequency-sweep signal comprising a sweeping noise having a bandwidth of about 2 MHz.

7. The jamming device of claim 1, further comprising:

a power amplification circuit coupled to the sweep-signal generating circuit and configured to amplify the frequency-sweep signal to generate an amplified frequency-sweep signal.

8. The jamming device of claim 7, further comprising:

an antenna coupled to the power amplification circuit and configured to transmit the amplified frequency-sweep signal.

9. The jamming device of claim 1, wherein the periodic signal generating circuit is configured to generate the periodic signal having a period between about 5 μs to about 10 μs.

10. The jamming device of claim 1, wherein the periodic signal generating circuit comprises a sawtooth wave generating circuit configured to generate a sawtooth wave as the periodic signal.

11. The jamming device of claim 10, wherein the sawtooth wave generating circuit comprises a 555 timer.

12. The jamming device of claim 11, wherein the 555 timer is configured to be in an astable mode.

13. The jamming device of claim 1, wherein the periodic signal generating circuit comprises a triangle wave generating circuit configured to generate a triangle wave as the periodic signal.

14. The jamming device of claim 1, wherein the noise generating circuit is configured to generate a narrow-band white Gaussian noise as the noise signal.

15. The jamming device of claim 14, wherein the noise generating circuit comprises a Zener diode.

16. The jamming device of claim 15, wherein the noise generating circuit further comprises:

an audio amplification circuit coupled to the Zener diode and configured to amplify an output of the Zener diode; and a filter circuit coupled to the audio amplification circuit and configured to filter an output of the audio amplification circuit.

17. The jamming device of claim 16, wherein the noise generating circuit further comprises an amplitude adjusting circuit coupled to the filter circuit and configured to adjust an amplitude of an output of the filter circuit.

18. The jamming device of claim 17, wherein the amplitude adjusting circuit comprises an adjustable resistor or a variable-gain amplifier.

* * * * *